US008467707B2

(12) United States Patent
Takiguchi et al.

(10) Patent No.: US 8,467,707 B2
(45) Date of Patent: Jun. 18, 2013

(54) IMAGE FORMING AGENT STORAGE UNIT, METHOD FOR FILLING IMAGE FORMING AGENT STORAGE UNIT WITH IMAGE FORMING AGENT, AND IMAGE FORMING APPARATUS

(75) Inventors: Toshio Takiguchi, Saitama (JP); Kazuaki Sugawara, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 294 days.

(21) Appl. No.: 12/814,062

(22) Filed: Jun. 11, 2010

(65) Prior Publication Data

US 2011/0064476 A1 Mar. 17, 2011

(30) Foreign Application Priority Data

Sep. 16, 2009 (JP) ..... 2009-214085

(51) Int. Cl.
*G03G 15/08* (2006.01)

(52) U.S. Cl.
USPC ..... 399/262; 399/120; 399/252; 399/258

(58) Field of Classification Search
USPC ..... 399/262, 120, 252, 258
See application file for complete search history.

(56) References Cited

U.S. PATENT DOCUMENTS

| | | | | |
|---|---|---|---|---|
| 5,585,889 | A | 12/1996 | Shishido et al. | |
| 2006/0182469 | A1 * | 8/2006 | Koyama et al. | 399/258 |
| 2009/0016779 | A1 * | 1/2009 | Hwang | 399/262 |
| 2009/0035014 | A1 | 2/2009 | Sato | |
| 2009/0080935 | A1 | 3/2009 | Iikura et al. | |
| 2009/0129823 | A1 | 5/2009 | Koshimori et al. | |
| 2009/0297216 | A1 | 12/2009 | Kawai | |

FOREIGN PATENT DOCUMENTS

| | | |
|---|---|---|
| JP | A-62-35383 | 2/1987 |
| JP | A-63-109956 | 5/1988 |
| JP | A-01-126666 | 5/1989 |
| JP | A-01-166363 | 6/1989 |
| JP | A-02-157775 | 6/1990 |
| JP | A-08-30167 | 2/1996 |
| JP | A-2002-251062 | 9/2002 |
| JP | A-2009-36921 | 2/2009 |
| JP | A-2009-122543 | 6/2009 |
| JP | A-2009-186554 | 8/2009 |

OTHER PUBLICATIONS

Office Action issued in Japanese Patent Application No. 2009-214085, on Nov. 13, 2009 (with translation).
Oct. 14, 2011 Office Action issued for Australian Application No. 2010202616.
Notification of Reasons for Refusal dated Nov. 12, 2010 in corresponding Japanese Patent Application No. 2009-214085 (with translation).
Australian Office Action issued in Australian Application No. 2010202616 dated May 9, 2011.

* cited by examiner

*Primary Examiner* — Ryan Walsh
(74) *Attorney, Agent, or Firm* — Oliff & Berridge, PLC

(57) ABSTRACT

An image forming agent storage unit includes a body portion and a pair of a protrusion portion. The body portion extends in an insertion direction in which the image forming agent storage unit is inserted into an image forming apparatus. The pair of a protrusion portion is disposed on an outer face of the body portion and extends along the insertion direction. An approximate geometrical center of gravity of a cross-sectional shape of the body portion is disposed between the pair of the protrusion portion. One of the protrusion portions is disposed on an upper right angle position between an upper portion of the body portion and a right portion of the body portion and the other of the protrusion portions is disposed on a lower left angle position between a lower portion of the body portion and a left portion of the body portion.

11 Claims, 14 Drawing Sheets

IMAGE FORMING AGENT STORAGE UNIT, METHOD FOR FILLING IMAGE FORMING AGENT STORAGE UNIT WITH IMAGE FORMING AGENT, AND IMAGE FORMING APPARATUS

CROSS-REFERENCE TO RELATED APPLICATIONS

This application is based upon and claims priority under 35 USC 119 from Japanese Patent Application No. 2009-214085, filed Sep. 16, 2009.

BACKGROUND

Technical Field

The present invention relates to an image forming agent storage unit, a method for filling the image forming agent storage unit with an image forming agent, and an image forming apparatus.

SUMMARY OF THE INVENTION

According to an aspect of the invention, an image forming agent storage unit includes a body portion and a pair of a protrusion portion. The body portion extends in an insertion direction in which the image forming agent storage unit is inserted into an image forming apparatus. The pair of a protrusion portion is disposed on an outer face of the body portion and extends along the insertion direction. When the image forming agent storage unit is seen from the insertion direction in which the image forming agent storage unit is inserted into the image forming apparatus, an approximate geometrical center of gravity of a cross-sectional shape of the body portion is disposed between the pair of the protrusion portion. When the image forming agent storage unit is seen from the insertion direction in which the image forming agent storage unit is inserted into the image forming apparatus, one of the protrusion portions is disposed on an upper right angle position between an upper portion of the body portion and a right portion of the body portion and the other of the protrusion portions is disposed on a lower left angle position between a lower portion of the body portion and a left portion of the body portion.

BRIEF DESCRIPTION OF THE DRAWINGS

Exemplary embodiments of the invention will be described in detail based on the following figures, wherein.

DETAILED DESCRIPTION

Image Forming Apparatus

Figure 1:
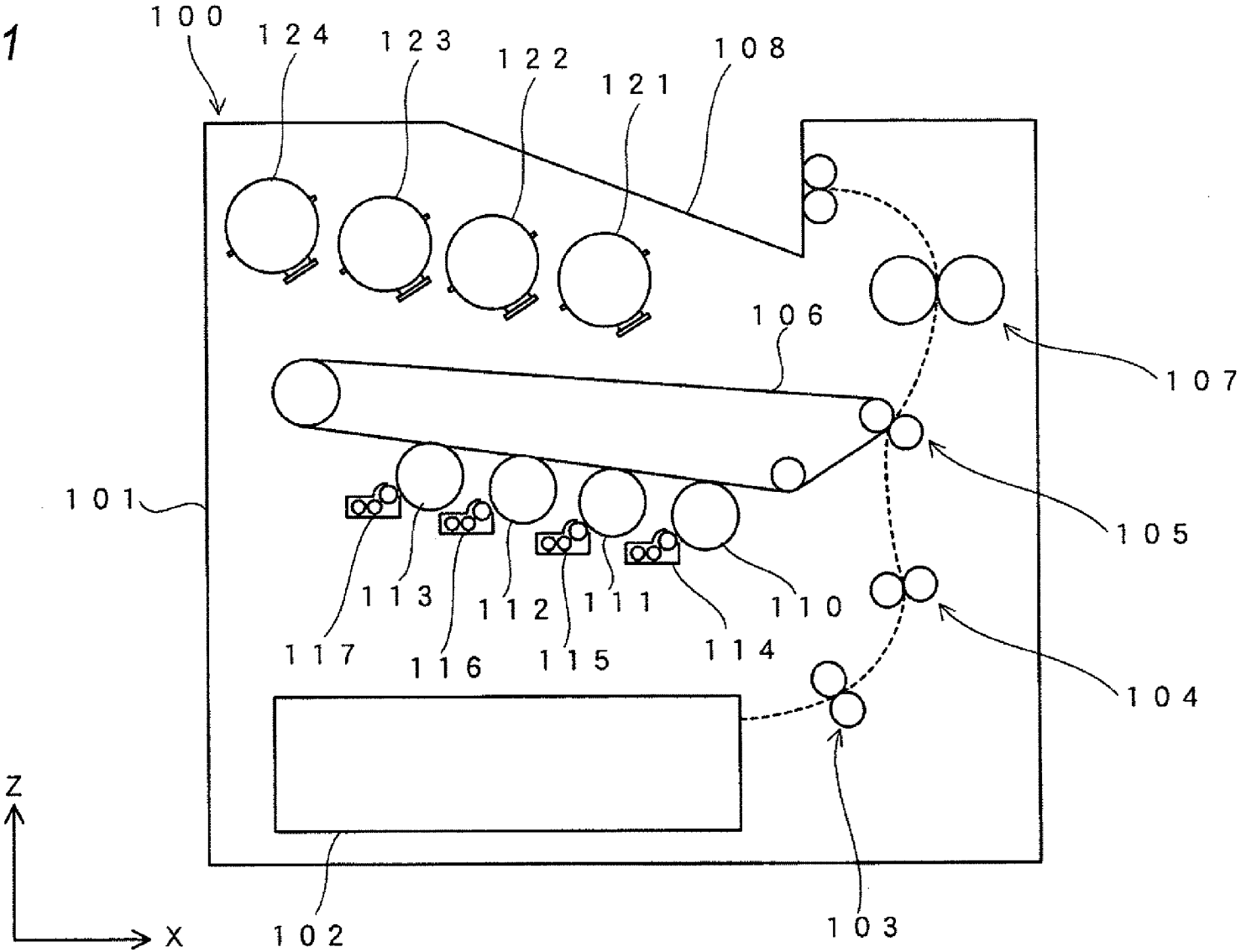
FIG. 1 is a conceptual view of an image forming apparatus according to an embodiment.

An embodiment of the invention will be described below. FIG. 1 is a conceptual view of an image forming apparatus according to the embodiment. In FIG. 1, an image forming apparatus 100 is depicted. The image forming apparatus 100 has a function of forming an image on an image recording medium (for example, a sheet of paper) based on image data supplied from the outside, and outputting the image recording medium with the image formed thereon. The image forming apparatus 100 has a body 101. In this embodiment, the body 101 has a paper storage unit 102 which stores a plurality of sheets of paper on which images will be formed.

A sheet of paper stored in the paper storage unit 102 is conveyed to a secondary transfer portion 105 through conveyance mechanisms 103 and 104 using rotating rolls. By the secondary transfer portion 105, toner images primarily transferred onto a transfer belt 106 are secondarily transferred onto the sheet of paper conveyed from the conveyance mechanism 104. The secondary transfer portion 105 has a pair of rolls. The secondary transfer portion 105 performs the secondary transfer by supplying potential between the rolls while holding the sheet of paper and the transfer belt 106 between the rolls.

Toner images of respective colors Y, M, C and K from photoconductor drums 110, 111, 112 and 113 are primarily transferred onto the transfer belt 106. The primary color toner images are put on top of each other on the transfer belt 106. Thus, a color toner image is formed on the transfer belt 106.

For example, a cleaning unit (not shown) for cleaning residual toner, a charging unit (not shown) for charging the surface of the photoconductor drum 110, an exposure unit (not shown) for irradiating the charged surface of the photoconductor drum 110 with light rays to partially expose the surface of the photoconductor drum 110 to the light rays and thereby form a latent image thereon, a developing unit 114 for supplying toner (image forming agent) to the latent image to develop the latent image are disposed around the photoconductor drum 110. The same configuration can be applied to any other photoconductor drum. In FIG. 1, a developing unit 115 for carrying out development on the surface of the photoconductor drum 111, a developing unit 116 for carrying out development on the surface of the photoconductor drum 112, and a developing unit 117 for carrying out development on the surface of the photoconductor drum 113 are shown.

Toner storage units (as examples of image forming agent storage units) 121, 122, 123 and 124 storing toners (as examples of image forming agents) of the respective colors Y, M, C and K are removably mounted inside the image forming apparatus 100. Each toner storage unit 121-124 has a structure which can be inserted into and detached from the body 101 and replaced by a new one when toner has been used up. The structure which can be inserted into and detached from the body 101 and replaced by a new one will be described later. In addition, in the image forming apparatus 100, the direction of each toner storage unit 121-124 with respect to the body 101 (direction with respect to the X-axis, Y-axis and Z-axis directions) is fixed without being changed in accordance with operation once the toner storage unit 121-124 is mounted.

Toner is supplied from the toner storage unit 121 to the developing unit 114 through a not-shown toner conveyance mechanism. In the same manner, toner is supplied from the toner storage unit 122 to the developing unit 115, toner is supplied from the toner storage unit 123 to the developing unit 116, and toner is supplied from the toner storage unit 124 to the developing unit 117.

The sheet of paper having the toner images secondarily transferred thereto from the transfer belt 106 by the secondary transfer portion 105 is sent to a fixing unit 107, in which the toner images are fixed onto the sheet of paper. The image fixing unit 107 has a pair of rolls, by which heat and pressure are applied to the sheet of paper to fix the unfixed toner images onto the sheet of paper. The sheet of paper where the images have been fixed is discharged to a paper discharge surface 108.

(Toner Storage Unit)

Figure 2:
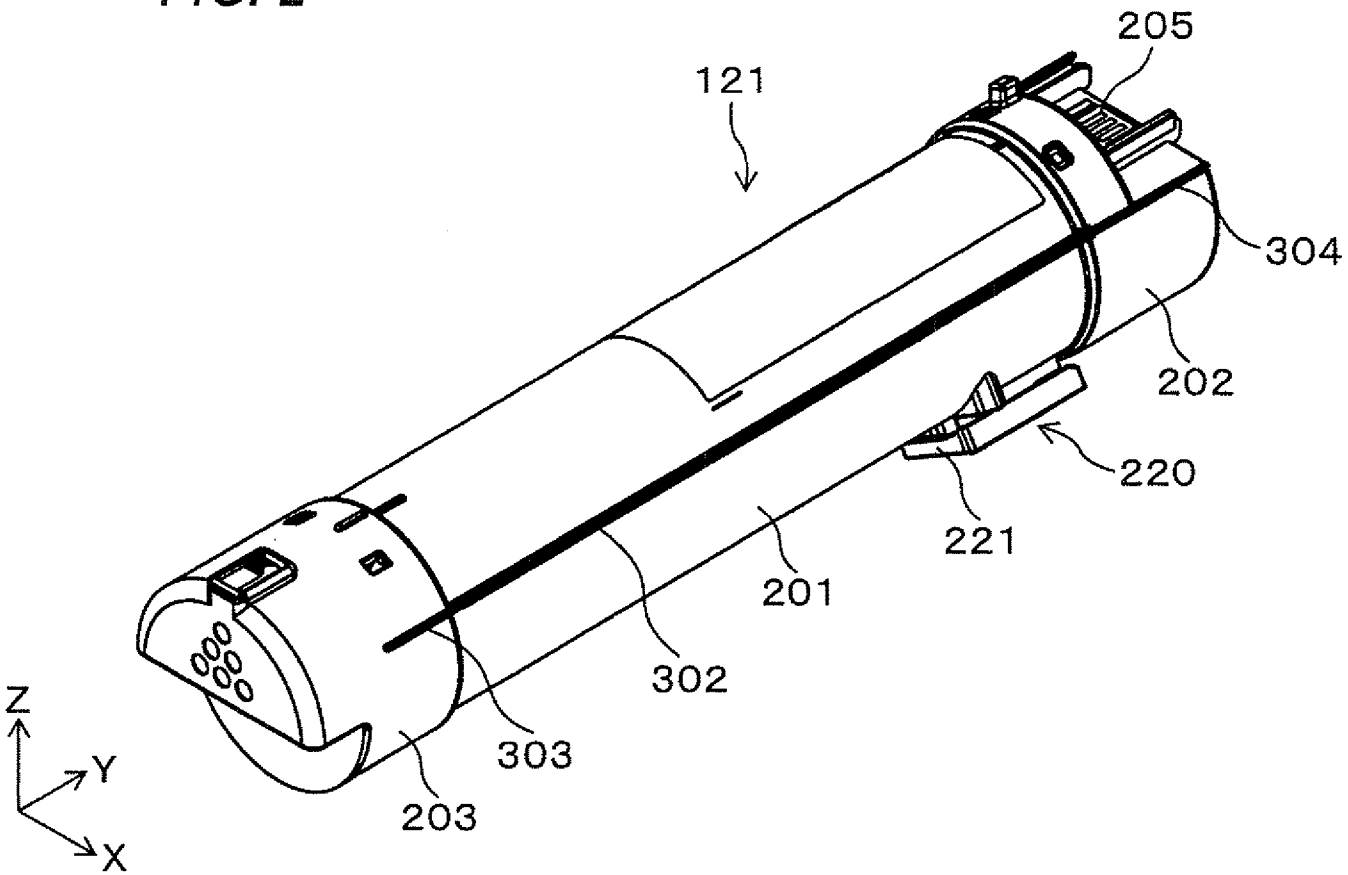
FIG. 2 is a perspective view of a toner storage unit.
Figure 3B:
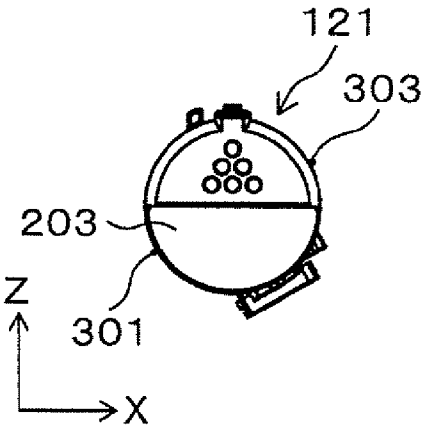
FIGS. 3A and 3B are a side view and a back view of the toner storage unit.
Figure 4B:
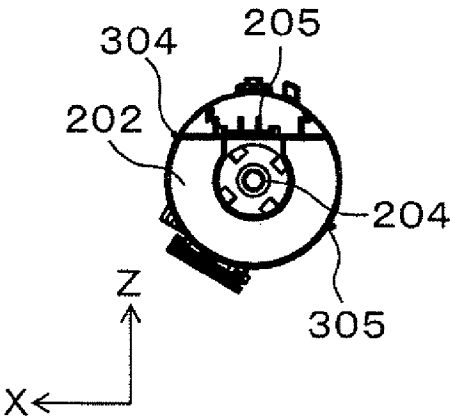
FIGS. 4A and 4B are a side view and a front view of the toner storage unit.
Figure 3A:
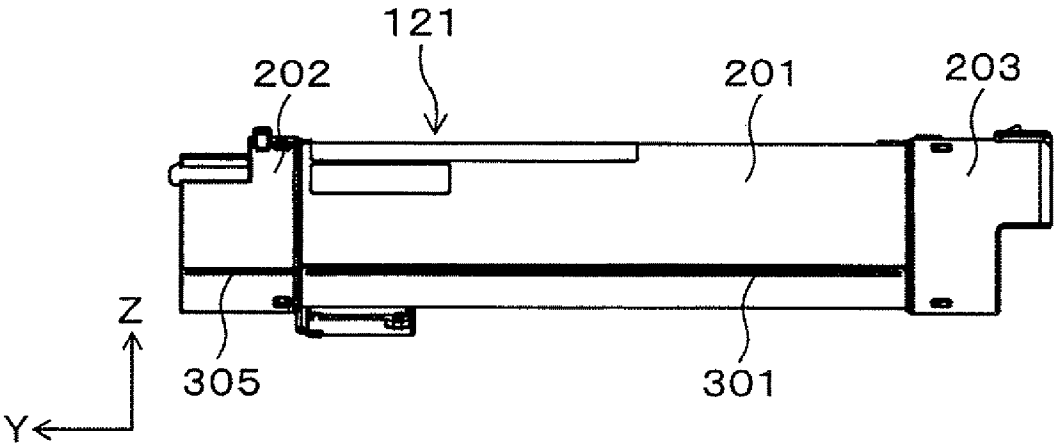
Figure 4A:
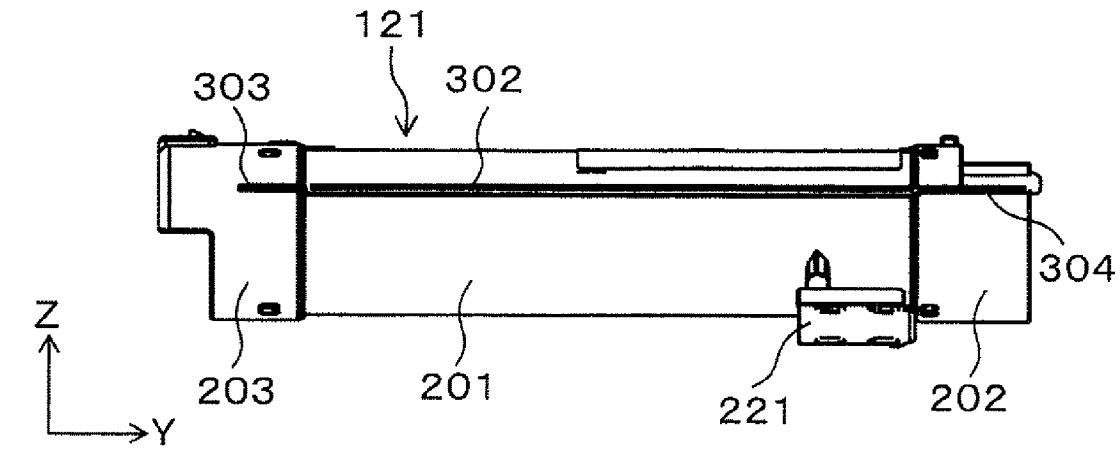

An example of the toner storage unit 121-124 in FIG. 1 will be described below. The toner storage units 121-124 are the same, except that the colors (kinds) of stored toners are different. Here, description will be made on the toner storage unit 121. FIG. 2 is a perspective view of a toner storage unit according to the embodiment. FIG. 3A is a side view of the toner storage unit according to the embodiment, and FIG. 3B is a back view thereof. FIG. 4A is a side view of the toner storage unit according to the embodiment, and FIG. 4B is a front view thereof.

FIG. 2, FIGS. 3A-3B and FIGS. 4A-4B show the toner storage unit 121. The toner storage unit 121 has a structure in which a front end portion 202 and a grip portion 203 are provided in the front and rear end portions of a cylindrical body portion 201 in its longitudinal direction, which is the axial direction of the cylindrical body portion 201, that is, the direction in which the toner storage unit 121 will be mounted in the body 101 of the image forming apparatus 100. The front end portion 202 is disposed on the side which will be inserted into the image forming apparatus 100 when the toner storage unit 121 is mounted in the image forming apparatus 100. The grip portion 203 is attached to an operator's side in the insertion direction. The grip portion 203 serves as a portion which can be gripped by a hand when the toner storage unit 121 is mounted in and removed from (that is, inserted into and detached from) the body 101 of the image forming apparatus 100 of FIG. 1.

Figure 5:
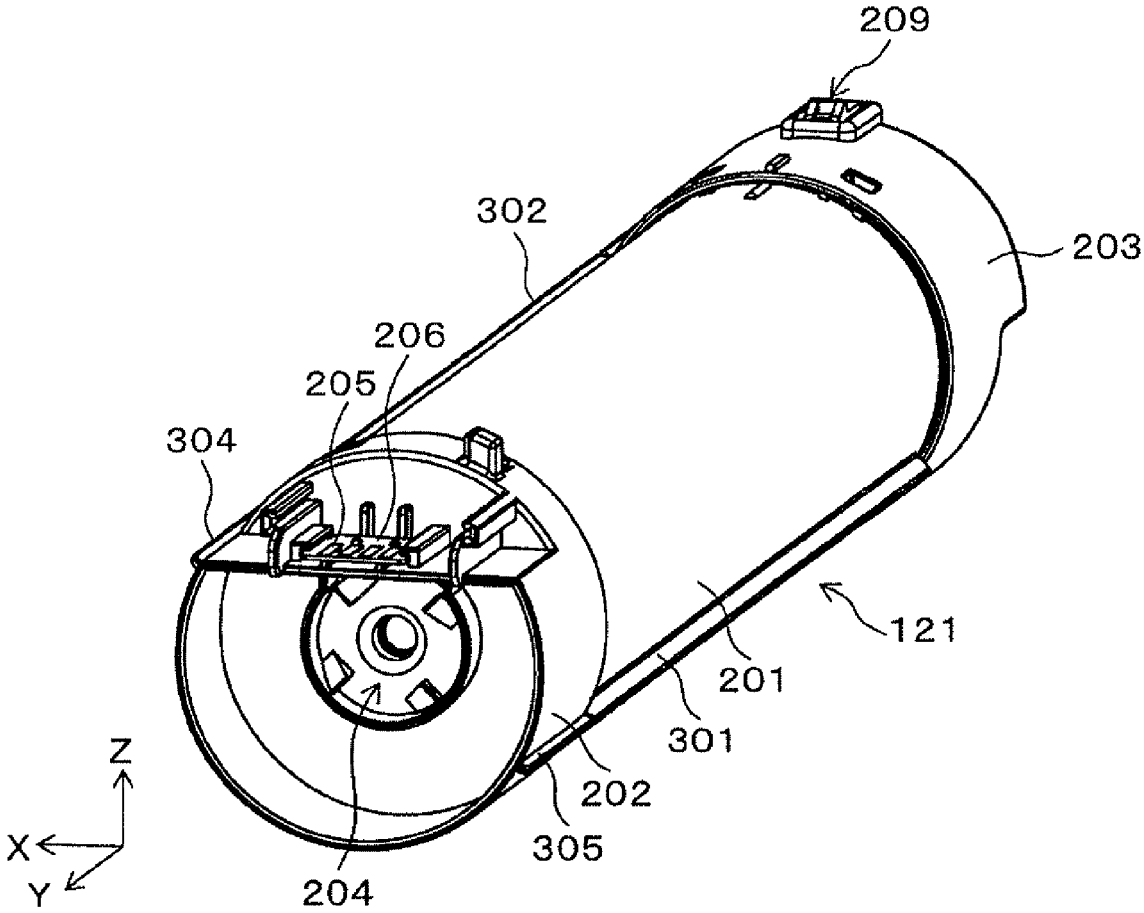
FIG. 5 is a partially enlarged perspective view of the toner storage unit.

FIG. 5 is a perspective view showing the front end portion. FIG. 5 shows the front end portion 202. When the front end portion 202 is pushed into the image forming apparatus 100, the toner storage unit 121 can be mounted in the image forming apparatus 100.

The front end portion 202 has a coupling gear 204. The coupling gear 204 gears with a driving gear disposed on the image forming apparatus 100 side when the toner storage unit 121 has been mounted in the image forming apparatus 100. In this state, when the driving gear is rotated by a motor, the coupling gear 204 gearing with the driving gear is rotated.

A conveyance means (not shown) is connected to the coupling gear 204. The conveyance means conveys toner, while stirring the toner, in the axial direction (the Y-axis direction in FIG. 5), i.e. the direction in which the toner storage unit 121 is inserted into the body 101 of the image forming apparatus 100 and which is the longitudinal direction of the cylindrical body portion 201. The conveyance means is composed of a wire formed into a spiral shape. When the coupling gear 204 is rotated, the conveyance means is rotated around the Y-axis direction so as to convey the toner stored in the body portion 201 forward in the Y-axis direction in FIG. 5 while stirring the toner.

As shown in FIG. 5, a signal terminal 205 is disposed in the front end portion 202. The signal terminal 205 is provided on a board 206. An IC memory (not shown) is attached to an opposite surface of the board 206 to the surface where the signal terminal 205 is provided. Information about the color of the stored toner or the like, information of a remaining amount of the toner, etc. are stored in the IC memory. When the toner storage unit 121 has been mounted in the image forming apparatus 100, these pieces of information can be electronically read from and written into the IC memory through the signal terminal 205 by the body 101.

Figure 6:
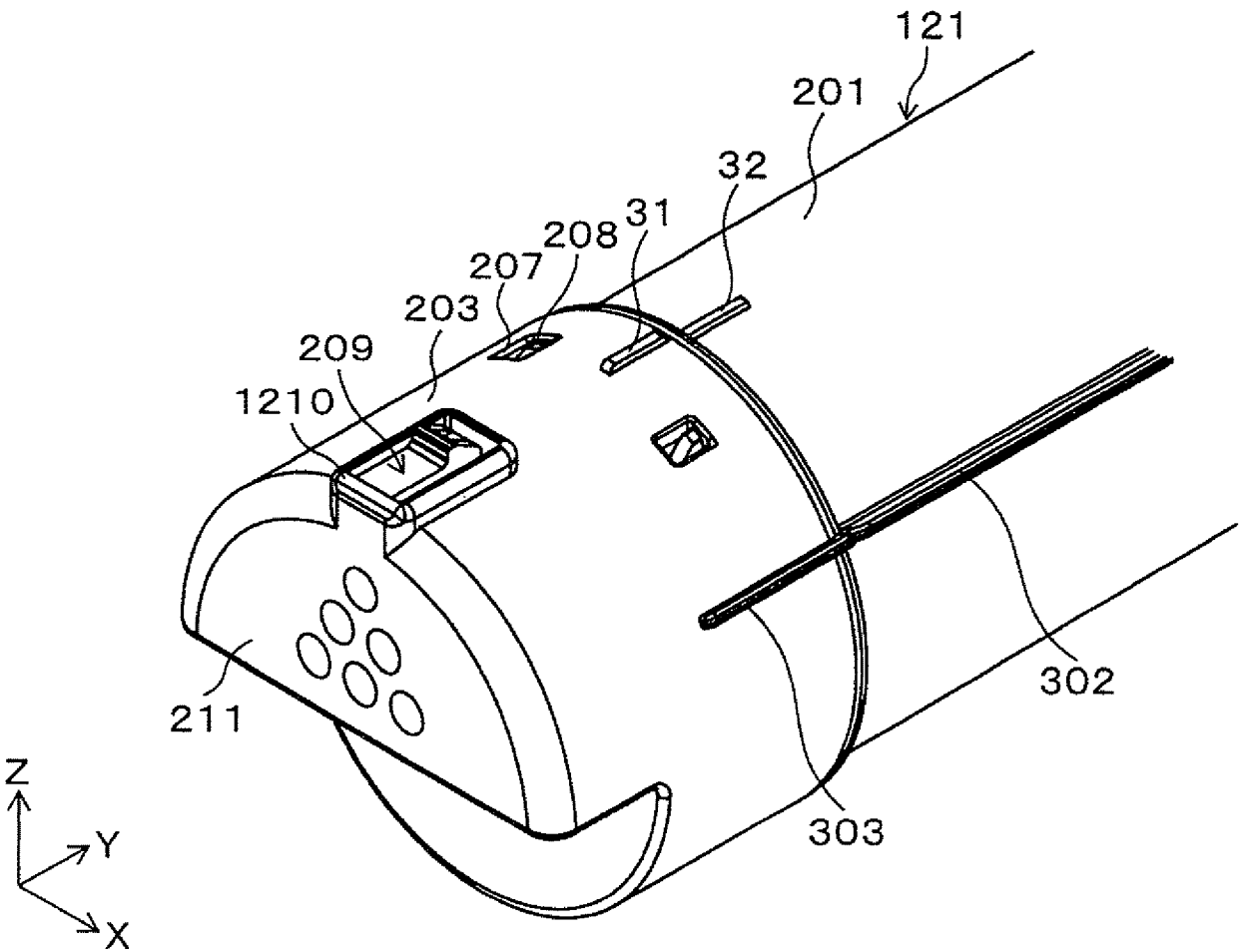
FIG. 6 is a partially enlarged perspective view of the toner storage unit.
Figure 7:
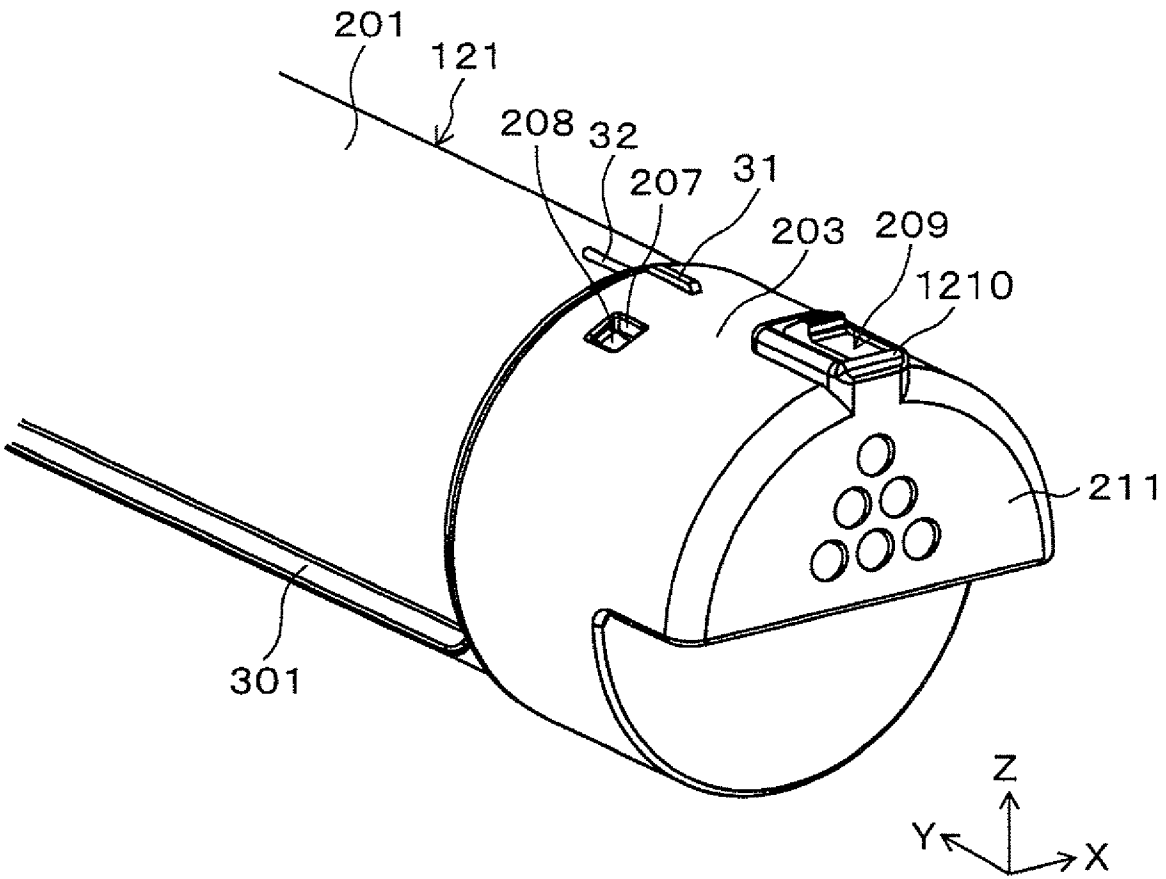
FIG. 7 is a partially enlarged perspective view of the toner storage unit.

FIGS. 6 and 7 are perspective views showing the grip portion. FIGS. 6 and 7 show the grip portion 203. The grip portion 203 is mechanically connected with the body portion 201 by a fitting-in structure. That is, an opening 207 is provided in the grip portion 203. On the other hand, a claw portion 208 which can be fitted into the opening 207 and caught by the opening 207 is provided on the body 101 side. When the grip portion 203 is pushed into the body portion 201, the claw portion 208 is fitted into the opening 207, and the claw portion 208 is caught on the edge of the opening 207. Thus, the grip portion 203 is mounted on the body portion 201.

A hollow structure is formed inside an end surface 211 of the grip portion 203, so that when a finger is put into the hollow structure, a force backward in the Y-axis direction can be applied easily by a hand put on the end surface 211. Not to say, according to the structure, the end surface 211 can be pushed forward in the Y-axis direction.

A movement preventing member 209 is disposed in a top portion (located in the 12 o'clock direction in accordance with positions of clock's hands) of the grip portion 203. The movement preventing member 209 is disposed inside a rectangular edge portion 1210 raised from the surroundings. The movement preventing member 209 is made from resin and formed into a structure which can be elastically deformed in the Z-axis direction in FIG. 5.

FIGS. 8A-8D and 9A-9D are conceptual views for explaining the operation of the movement preventing member. FIGS. 8A-8D and 9A-9D show the movement preventing member 209 which is also shown in FIG. 6. The movement preventing member 209 has an extension portion 21 and a hook portion 22. The extension portion 21 is formed into a plate having a longitudinal shape. A tip portion of the extension portion 21 is formed as the hook portion 22, and an opposite end (root portion) to the hook portion 22 is coupled with the grip portion 203. The hook portion 22 has a first slope surface 23, a hook surface 24 and a second slope surface 25.

FIGS. 8A-8D show a contact member 210 on the body 101 side of the image forming apparatus 100. Here, description will be made in the case where the toner storage unit 121 is moved forward in the Y-axis direction in FIGS. 8A-8D so as to be mounted in the image forming apparatus 100.

Figure 8A:
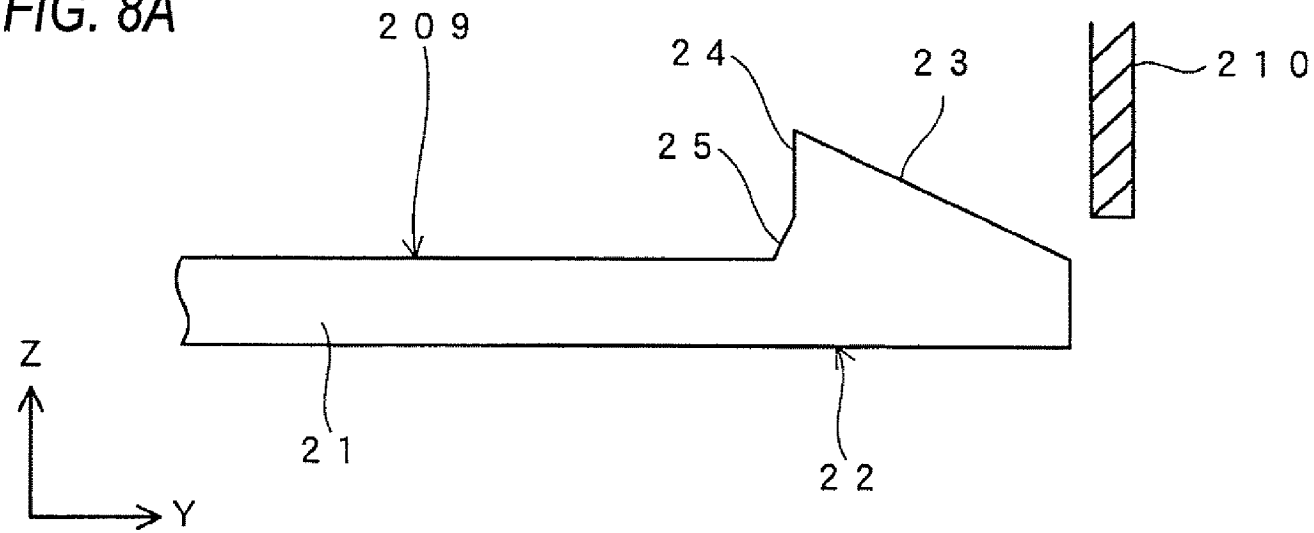
FIGS. 8A to 8D are conceptual views showing the operation of a movement preventing member.
Figure 8B:
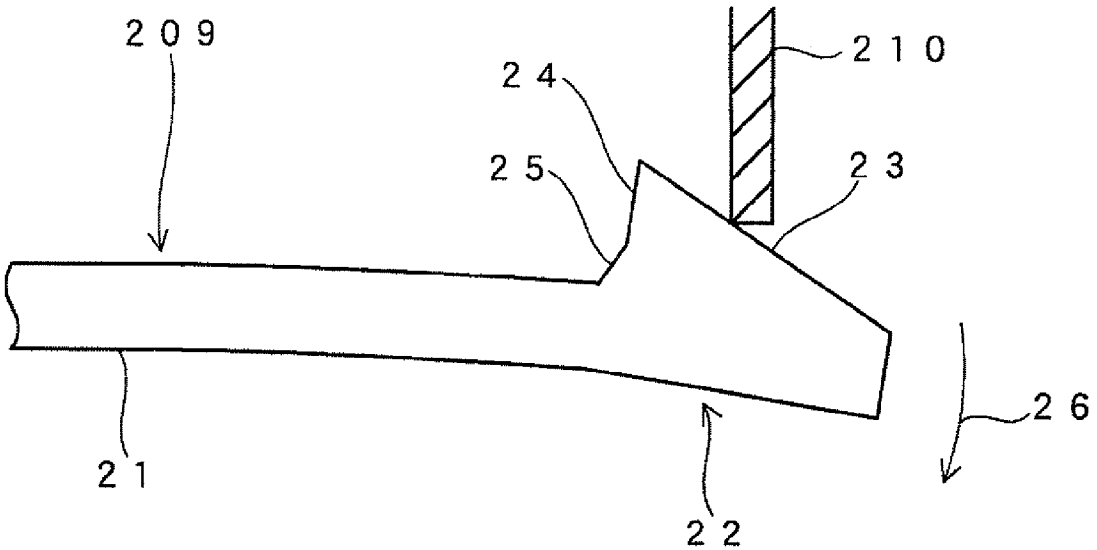

In this case, when the toner storage unit 121 is pushed into the image forming apparatus 100, the contact member 210 approaches the hook portion 22 (FIG. 8A). Then, when the contact member 210 touches the first slope surface 23, the extension portion 21 can be deformed elastically, and the hook portion 22 moves toward an arrow 26 (FIG. 8B).

Figure 8C:
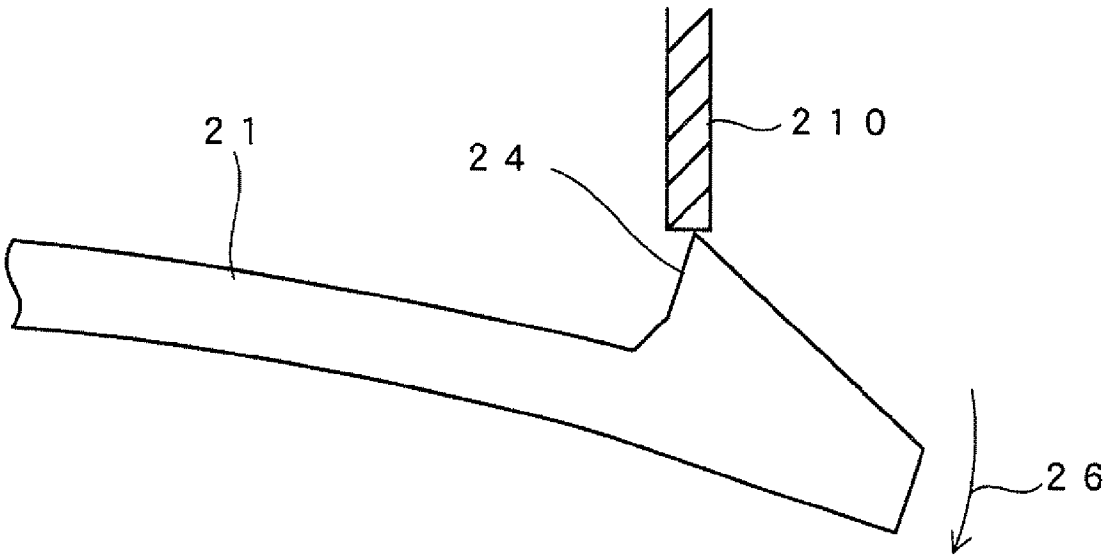

When the toner storage unit 121 is further pushed into the image forming apparatus 100, the hook portion 22 moves further in the illustrated Y-axis direction, and the downward motion of the hook portion 22 toward the arrow 26 (that is, the deformation of the extension portion 21) becomes large as shown in FIG. 8C. After that, as soon as the contact member 210 gets over the border (edge of the first slope surface) between the first slope surface 23 and the hook surface 24, the elastically deformed extension portion 21 restitutes as shown in FIG. 80.

In this state, even if there is an intention to move the movement preventing member 209 (that is, the toner storage unit 121) backward in the Y-axis direction of FIG. 80, the movement can be prevented due to the hook surface 24 which is in contact with the contact member 210 and caught thereon. That is, the toner storage unit 121 mounted in the image forming apparatus 100 is prevented from moving in a direction in which the toner storage unit 121 can be pulled out (removed). The prevention of the movement in the direction in which the toner storage unit 121 can be pulled out acts against a reaction force the toner storage unit 121 receives from the coupling gear 204 which will be described later and a reaction force the toner storage unit 121 receives from a spring for urging a not-shown cover member provided on the body 101 side of the image forming apparatus 100 as will be described later. That is, if a force stronger than a resultant force of the aforementioned two reaction forces is applied to the toner storage unit 121 by an operator when the toner storage unit 121 is pulled out from the inside of the image forming apparatus 100, the toner storage unit 121 can be pulled out from the inside of the image forming apparatus 100.

Description will be made on the operation to remove the toner storage unit 121. In order to remove (pull out) the toner storage unit 121 from the body 101 of the image forming apparatus 100, a finger is hung on the end surface 211 in FIG. 6 and a force is applied thereto backward in the Y-axis direction. That is, a finger is hung on a cavity inside the end surface 211 of the grip portion 203 and a force is applied thereto to pull out the toner storage unit 121 backward in the Y-axis direction.

Figure 9A:
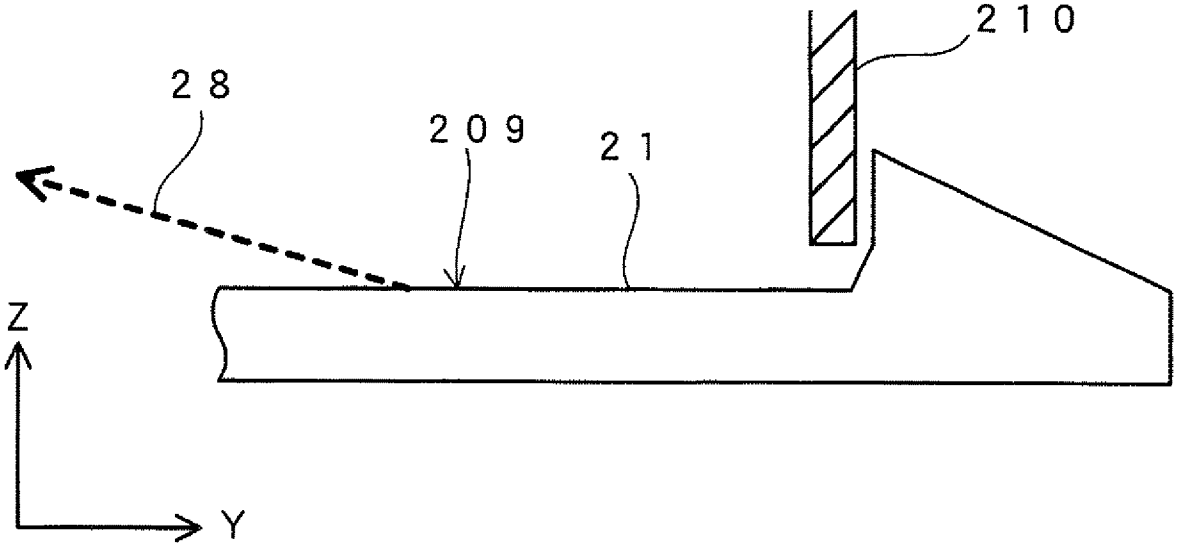
FIGS. 9A to 9D are conceptual views showing the operation of the movement preventing member.
Figure 9B:
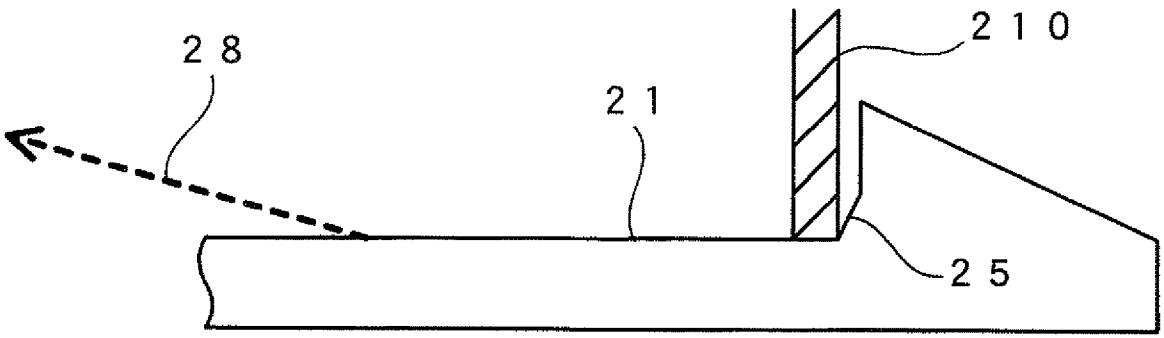

On this occasion, the force may act upward, that is, vertically upward in the Z-axis direction. In this case, the force is applied in the direction of an arrow 28 (FIG. 9A). As a result, as soon as the movement preventing member 209 is pulled out, the movement preventing member 209 is lifted a little (that is, moves forward in the Z-axis direction). Thus, the contact member 210 comes in contact with the extension portion 21 or the second slope surface 25. FIG. 9B shows the state where the contact member 210 has been in contact with the second slope surface 25.

Figure 9C:
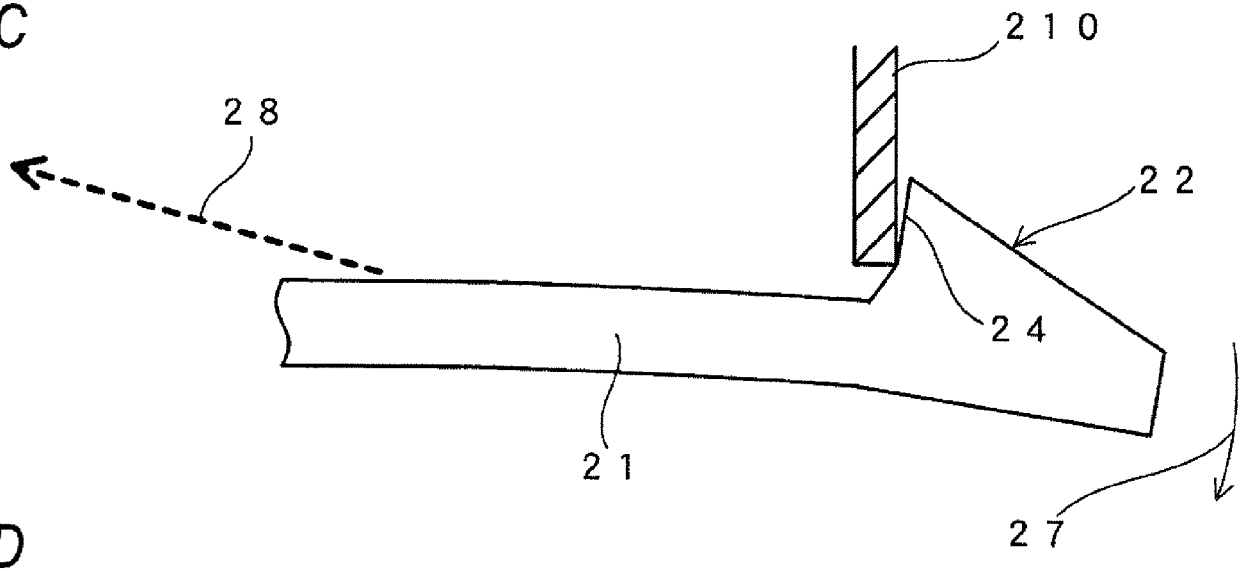

Successively in the state of FIG. 9B, when the force to pull out the toner storage unit 121 backward in the Y-axis direction is continuously applied thereto, the second slope surface 25 is brought into contact with the contact member 210 to elastically deform the extension portion 21. Thus, the hook portion 22 moves in the direction of an arrow 27 (FIG. 9C).

Figure 9D:
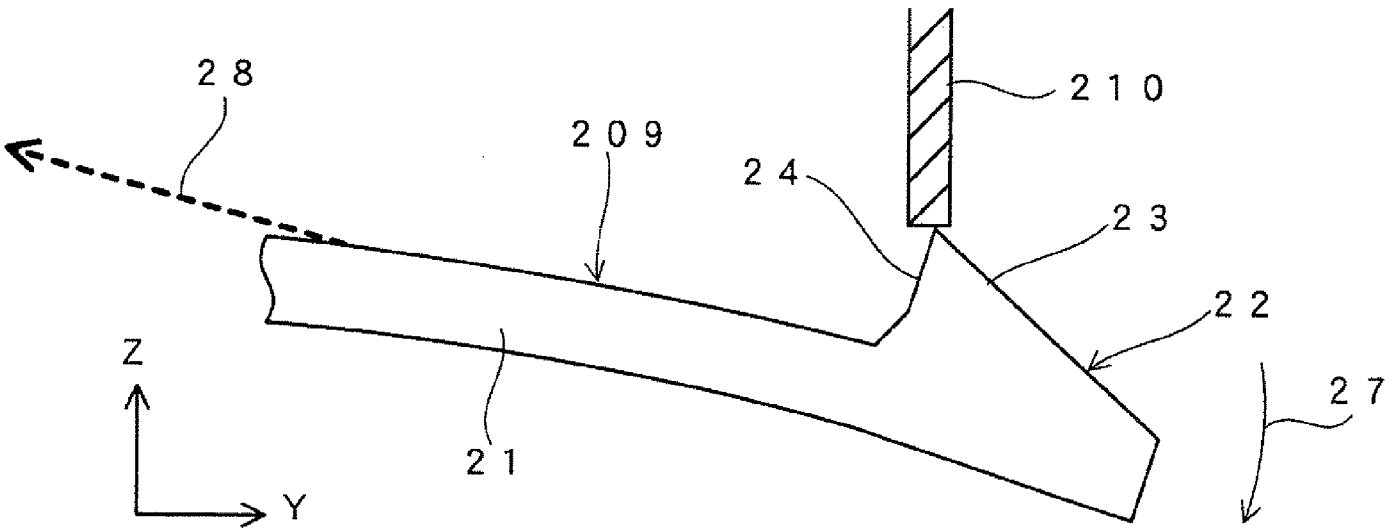

After that, the contact member 210 comes in contact with the hook surface 24 inclined with respect to the extension direction, so as to further increase the elastic deformation of the extension portion 21, to result in a state in FIG. 9D. As soon as the contact member 210 gets over the border (edge of the first slope surface 23) between the first slope surface 23 and the hook surface 24 from the right to the left in FIG. 9D, the extension portion 21 which has been elastically deformed begins to restitute. When the movement preventing member 209 further moves to the illustrated left, the movement preventing member 209 reaches the state of FIG. 8A. Thus, the movement preventing member 209 is released from the state where the movement preventing member 209 is caught on the contact member 210 to prevent the toner storage unit 121 from moving backward in the Y-axis direction. As a result, the toner storage unit 121 can be pulled out and removed from the image forming apparatus 100.

Assume that there is an intention to move the toner storage unit 121 backward in the Y-axis direction by a force as strong as the resultant force of the reaction force received from the coupling gear 204 and the reaction force received from the spring provided on the body 101 side and urging the not-shown cover member. In this case, the contact member 210 in contact with the hook surface 24 effects a function to prevent the toner storage unit 121 from moving backward in the Y-axis direction. Thus, the toner storage unit 121 can be prevented from moving backward in the Y-axis direction (to be pulled out). When the operator applies a force beyond the aforementioned resultant force to pull out the toner storage unit 121 from the inside of the image forming apparatus 100, the force is applied as a large force to the hook surface 24 hooked on the contact member 210. Thus, the extension portion 21 yields to the force to be elastically deformed to move in the direction of the arrow 27. As a result, the movement preventing function of the movement preventing member 209 is canceled. Assume that an upward (Z-axis direction) force acts on the movement preventing member 209 when the toner storage unit 121 is to be pulled out from the inside of the image forming apparatus 100. Also in this case, the movement preventing function of the movement preventing member 209 is canceled substantially in the same manner.

In addition, as shown in FIG. 6, the grip portion 203 is provided with a mark 31 for alignment with the body portion 201. A mark 32 to be paired with the mark 31 is provided in the body portion 201. When the marks 31 and 32 are aligned with each other, the grip portion 203 can be aligned in a rotational direction when the grip portion 203 is attached to the body portion 201.

As shown in FIGS. 2, 3A-3B and 4A-4B, a toner ejection portion 220 is disposed in the body portion 201 of the toner storage unit 121. The toner ejection portion 220 has a cover member 221 which can slide axially (Y-axis direction) to be opened/closed. When the toner storage unit 121 is pushed into a mounting portion of the image forming apparatus 100, the cover member 221 is brought into contact with the image forming apparatus 100. After that, when the toner storage unit 121 is further pushed into the mounting portion of the image forming apparatus 100, the body portion 201 is pushed into the mounting portion of the image forming apparatus 100, and the cover member 221 stays in the position where the cover member 221 is in contact with the image forming apparatus 100. As a result, the body portion 201 slides axially (forward in the Y-axis direction), and the cover member 221 slides relatively axially (backward in the Y-axis direction) to form an opening. Through the opening, toner inside the body portion 201 is supplied to the developing unit 114 (see FIG. 1) in the image forming apparatus 100. On the other hand, when the toner storage unit 121 is pulled out from the mounting portion of the image forming apparatus 100, the body portion 201 moves toward the cover member 221 staying behind. Thus, the body portion 201 slides axially (backward in the Y-axis direction), and the cover member 221 slides relatively axially (forward in the Y-axis direction) to close the opening. A not-shown cover member is also provided on the mounting portion side of the image forming apparatus 100. The cover member on the mounting portion side is urged to be closed by a spring. When the toner storage unit 121 is further pushed into the mounting portion of the image forming apparatus 100, the cover member on the mounting portion side is brought into contact with the toner storage unit 121 and opened. Thus, when the toner storage unit 121 is mounted in the mounting portion of the image forming apparatus 100, the toner storage unit 121 is pushed in a direction (backward in the Y-axis direction) to be pulled out from the mounting portion by the repulsive force of the spring.

As shown in FIGS. 3A-3B, FIGS. 4A-4B and FIGS. 5 to 7, the body portion 201 has protrusion portions 301 and 302 extending in the longitudinal direction (Y-axis direction) of the toner storage unit 121. A protrusion portion 305 having the same function as the protrusion portion 301 is provided in a position of the front end portion 202 extending axially from the protrusion portion 301. In addition, a protrusion portion 303 is provided in a position of the grip portion 203 extending axially from the protrusion portion 302, and a protrusion portion 304 is provided in a position of the front end portion 202 extending axially from the protrusion portion 302.

The set of the protrusion portions 301 and 305 and the set of the protrusion portions 302, 303 and 304 have sectionally convex shapes and are disposed in positions where the central axis of the circular body portion 201 is put therebetween (that is, in positions where any line connecting the set of the protrusion portions 301 and 305 with the set of the protrusion portions 302, 303 and 304 passes the central axis of the body portion 201) in view from the axial direction (Y-axis direction).

The set of the protrusion portions 301 and 305 and the set of the protrusion portions 302, 303 and 304 serve as guide members to mount the toner storage unit 121 in the image forming apparatus 100. That is, reception-side guides having sectionally concave shapes for receiving the set of the protrusion portions 301 and 305 and the set of the protrusion portions 302, 303 and 304 respectively are disposed in the body 101. The toner storage unit 121 is pushed into the image forming apparatus 100 in the state where the set of the protrusion portions 301 and 305 and the set of the protrusion portions 302, 303 and 304 have engaged with the reception-side guides in contact therewith. On this occasion, both the guide members are aligned with the partner members (reception-side guides) respectively. Thus, the toner storage unit 121 can be positioned in a rotational-angle position around the axis (around the Y-axis) and positioned in the X-Y plane. As a result, the toner storage unit 121 can be mounted in the state where the signal terminal 205 and the toner ejection portion 220 have been positioned with respect to the image forming apparatus 100.

As described above, the protrusion portions 301 and 302 are provided to extend all over the longitudinal direction of the body portion 201. Further, the protrusion portion 305 is disposed on the extension of the protrusion portion 301, and the protrusion portions 303 and 304 are disposed on the extension of the protrusion portion 302.

When the sectional center of the toner storage unit 121 is regarded as the central axis, in other words, when the toner storage unit 121 is viewed from the axial direction (Y-axis direction), the angle position of the protrusion portion 301, 305 around the axis (around the Y-axis) and the angle position of the protrusion portion 302, 303, 304 around the axis (around the Y-axis) are located on a line passing the axis (that is, any line connecting the set of the protrusion portions 301 and 305 with the set of the protrusion portions 302, 303 and 304 is located to pass the central axis in view from the axial direction (Y-axis direction), and further located in a lower left position and an upper right position in view from the Y-axis backward direction (in view from the grip portion 203 side). It is preferable that the upper right position is set in an angle position of 45°±20° on the assumption that the Z-axis direction is in an angle position of 0°, and the lower left position is set in an angle position of 225°±20° on the assumption that the Z-axis direction is in an angle position of 0°.

The sectional center of the toner storage unit 121 may be an approximate geometric center of gravity of a cross-sectional shape of the body portion. That is, any line connecting the set of the protrusion portions 301 and 305 with the set of the protrusion portions 302, 303 and 304 is located to pass the approximate geometric center of gravity in view from insertion direction of the toner storage unit 121 into the image forming apparatus.

The toner storage unit 121 has been described above. The same configuration can be also applied to the toner storage units 122 to 124.

(Advantages)

Figure 10A:
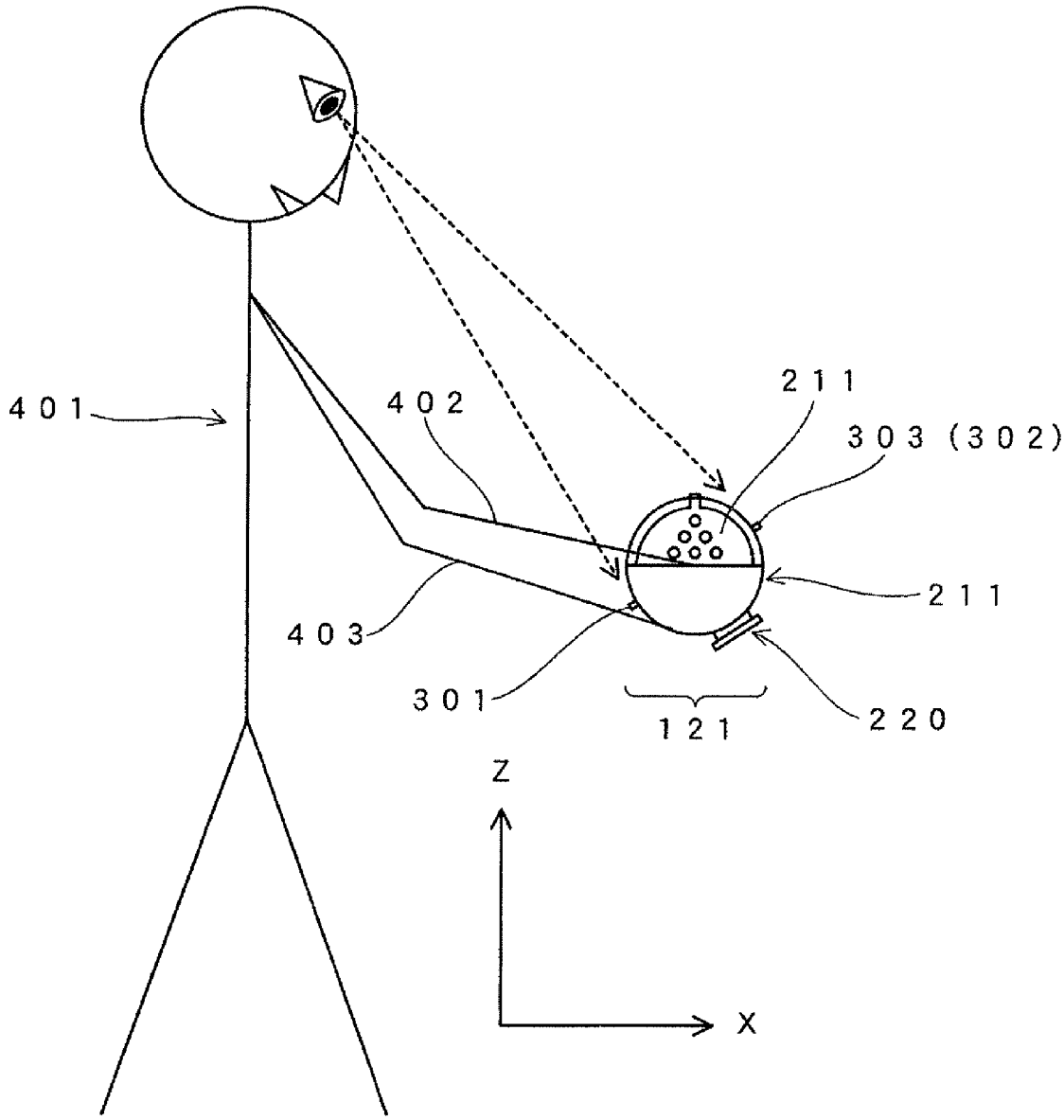
FIGS. 10A and 10B are conceptual views for explaining the visibility of the direction of the toner storage unit.
Figure 10B:
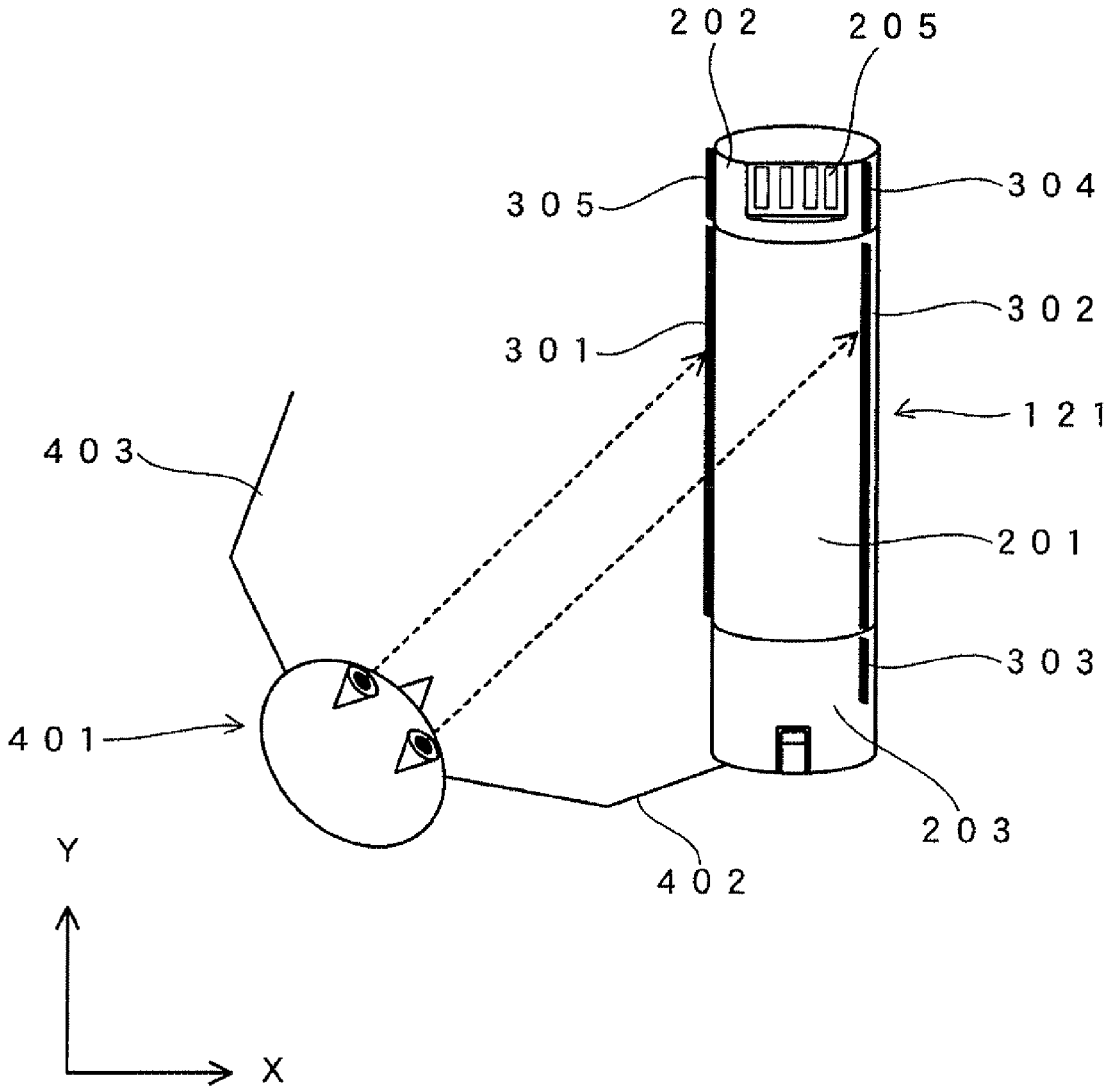

Description will be made below on the structural advantages of the toner storage units 121 to 124. FIGS. 10A-10B are conceptual views showing a state where the toner storage unit 121 is mounted in the image forming apparatus (not shown in FIGS. 10A-10B).

Generally, when a right-handed worker 401 mounts the toner storage unit 121 in the image forming apparatus 100, the worker 401 will grip the grip portion 203 (see FIGS. 6 and 7) of the toner storage unit 121 by a right hand 402 and push the grip portion 203 forward in the Y-axis direction while supporting the body portion 201 accessorily by a left hand 403 as shown in FIG. 10A. On this occasion, in the view point of FIG. 10A, due to the protrusion portion 303 (302) provided in the upper right angle position and the protrusion portion 301 provided in the lower left angle position, the worker 401 can recognize the respective protrusion portions visually and grasp their positional relationship easily as shown in FIG. 10A. That is, in the state of FIG. 10A, the worker 401 can recognize the protrusion portion 303 (302) and the protrusion portion 301 easily. In addition, the worker 401 can recognize the two protrusion portions visually even if the protrusion portions are low in height.

In addition, after the front end of the toner storage unit 121 has been pushed into the image forming apparatus 100, the worker 401 will release the left hand and push the grip portion 203 forward in the Y-axis direction by the right hand as shown in FIG. 10B. On this occasion, the worker 401 will be positioned on a side in an obliquely left rear of the toner storage unit 121 to view the toner storage unit 121 moving forward in the Y-axis direction. In that state, the worker 401 can recognize the right protrusion portions 304, 302 and 303 and the left protrusion portions 305 and 301 easily simultaneously.

The protrusion portion 303 (302) and the protrusion portion 301 serve as guides for determining the rotational angle position of the toner storage unit 121 seen from the view point of FIGS. 10A-10B. Operation for aligning the position with a position of a not-shown reception-side member on the image forming apparatus 100 side is required. According to this embodiment, as shown in FIGS. 10A-10B, the protrusion portion 303 (302) and the protrusion portion 301 are recognized visually so easily that the direction of the toner storage unit 121 can be determined easily and the alignment operation can be performed easily, as compared with the case where only one of the protrusion portions can be seen but the other cannot be seen.

Accordingly, it is possible to gain advantages such as lightening of a burden on a worker in the work of replacing a toner storage unit by a new one, sure mounting of the toner storage unit, prevention of the toner storage unit and/or the image forming apparatus from being damaged when the toner storage unit is mounted, and prevention of the toner storage unit from being mounted accidentally in a wrong direction.

In addition, with the structure in which the protrusion portion 303 (302) is disposed in the upper right angle position and the protrusion portion 301 is disposed in the lower left angle position in view from the grip portion 203 side, the space can be saved in the state where the toner storage units 121 to 124 have been arranged and mounted in the image forming apparatus 100. This point will be described below.

Figure 11:
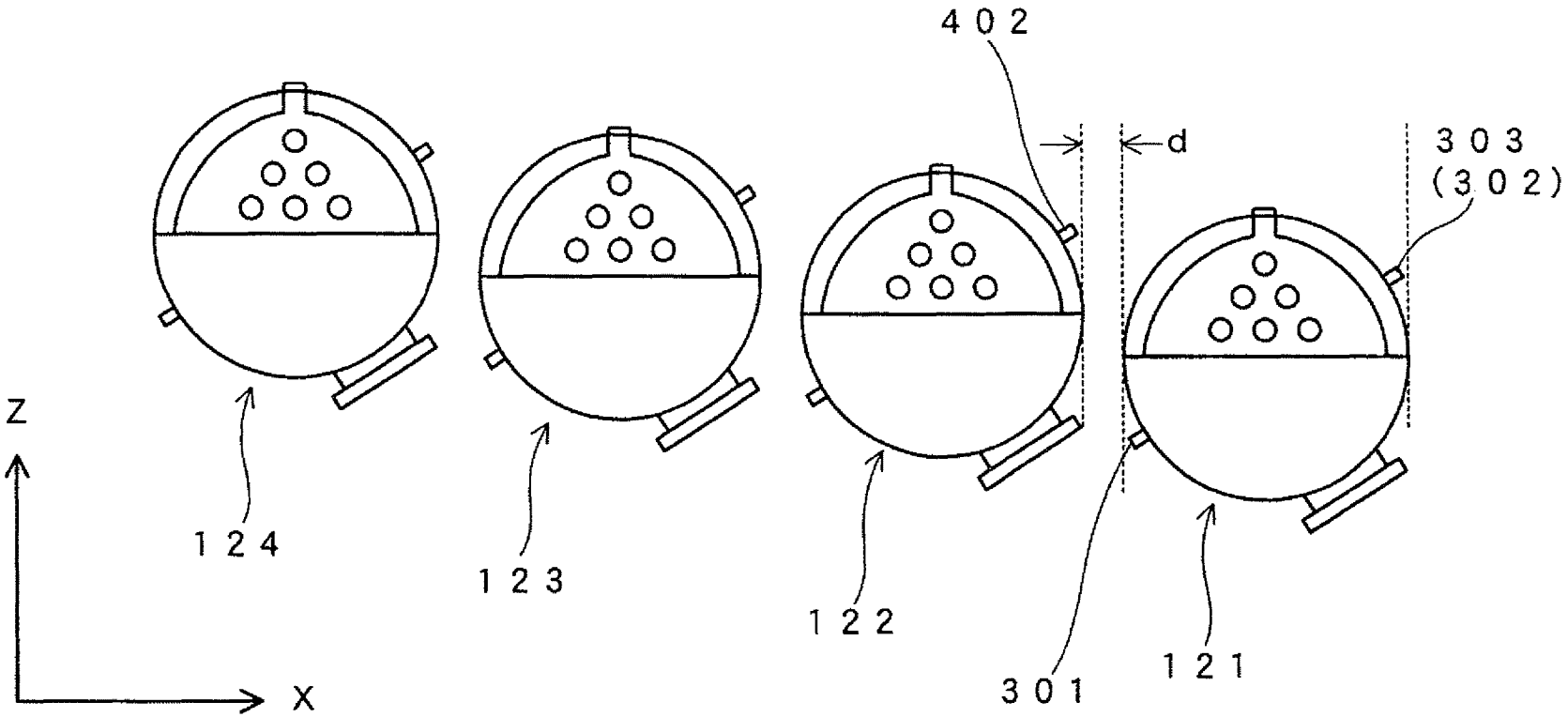
FIG. 11 is a conceptual view showing a state where the toner storage units are mounted in the image forming apparatus.

FIG. 11 is a conceptual view showing a state where toner storage units have been mounted in an image forming apparatus. The configuration of the image forming apparatus is not illustrated in FIG. 11. As shown in FIG. 11, in the toner storage unit 121, the protrusion portion 303 (302) serving as a guide when the toner storage unit 121 is mounted is disposed in an upper right angle position, and the protrusion portion 301 is disposed in a lower left angle position. In association with this structure, end portions of the protrusion portion 303 (302) and the protrusion portion 301 in the X-axis direction are located not to exceed the width of the toner storage unit 121. That is, when the toner storage unit mounted in the image forming apparatus 100 is viewed from above or below (that is, in the Z-axis direction), the edge portions of the protrusion portion 303 (302) and the protrusion portion 301 are put inside the lateral width (X-axis direction width) of the toner storage unit 121.

Protrusion portions on opposed sides of adjacent toner storage units are vertically displaced from each other as shown by the reference numerals 301 and 402 in FIG. 11. According to this structure, reception-side guide members adjacent to each other can be prevented from interfering with each other. It is therefore possible to narrow a distance d between toner storage units disposed adjacently to each other, so that the image forming apparatus can be miniaturized. This can be also applied to the relationship between the toner storage units 122 and 123 or between the toner storage units 123 and 124. In addition to such a positional relationship for contributing to miniaturization of the image forming apparatus, two protrusion portions can be recognized easily in spite of the low heights of the protrusion portions per se. Thus, the worker 401 can recognize the protrusion portion 303 (302) and the protrusion portion 301 easily.

In addition, since the protrusion portion 303 (302) and the protrusion portion 301 are located on the opposite sides of the axis of the extension direction of the toner storage unit 121, their guide function can be exerted so uniformly that the balance can be ensured easily when the toner storage unit 121 is mounted. In addition, the protrusion portions are provided to extend from the protrusion portion 303 through the protrusion portion 302 to the protrusion portion 304 as shown in FIG. 2, so that their effective distance can be ensured over a major longitudinal part of the toner storage unit 121. This can be also applied to the protrusion portions 301 and 305. Thus, the guide function can be obtained in a longer range so that the workability in mounting the toner storage unit 121 can be enhanced. In addition, since the protrusion portions exist to extend in a long range so that two protrusion portions can be recognized easily. Thus, the worker 401 can recognize the protrusion portion 303 (302) and the protrusion portion 301 easily.

A backward force in the Y-axis direction is applied to the coupling gear 204 in the toner storage unit 121 which has been mounted in the image forming apparatus 100. This is because a force based on the repulsive force of a spring is applied to a partner gear on the image forming apparatus side in order to ensure the engagement with the partner gear.

In addition, as described above, the toner storage unit 121 which has been mounted on the mounting portion of the image forming apparatus 100 is pushed in the portion of the toner ejection portion 220 in a direction (backward in the Y-axis direction) to be pulled out from the mounting portion, by the repulsive force of the spring.

Because of these reasons, a force to push the toner storage unit 121 backward in the illustrated Y-axis direction acts on the toner storage unit 121 which has been mounted in the image forming apparatus 100. According to this embodiment, the movement preventing member 209 (see FIG. 6) is provided to prevent the toner storage unit 121 from moving due to a backward force in the Y-axis direction applied thereto. Thus, the toner storage unit 121 which has been mounted in the image forming apparatus 100 can be prevented from being loosened or dropping out.

Figure 8D:
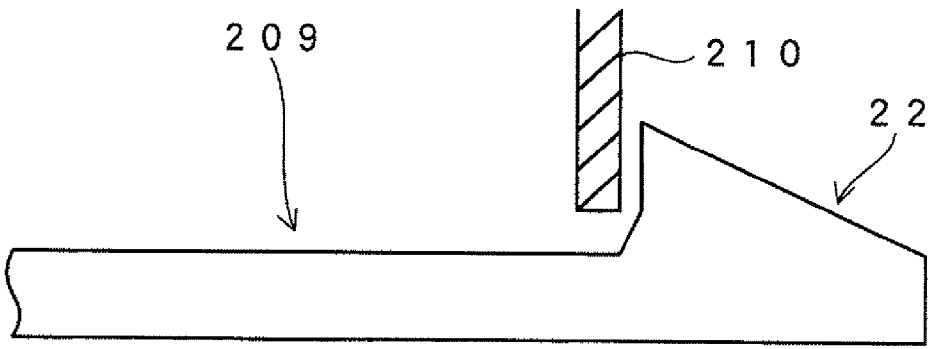

In addition, during transition from FIG. 80 to FIG. 8D to mount the toner storage unit 121 in the image forming apparatus 100, an impact of spring-up of the movement preventing member 209 is transmitted to the worker as a feeling of click. Thus, the worker can physically feel and confirm the fact that the toner storage unit 121 has been just and surely mounted.

Since the movement preventing member 209 is disposed in a top portion of the toner storage unit 121 which can be seen easily, the movement preventing member 209 also serves as a mark to align the toner storage unit 121 with the image forming apparatus 100. In addition, since the movement preventing member 209 is disposed in the top portion of the toner storage unit 121, the operation shown in FIGS. 9A-9D acts in the work of pulling the toner storage unit 121 with a hand on the grip portion 203, so that the movement preventing member 209 can be smoothly released from being hooked on the body side. Thus, the workability in removing the toner storage unit 121 can be enhanced.

In addition, in the state of FIG. 8D, the contact member 210 is closely opposed to a flat portion of the upper portion of the movement preventing member 209. The front end (lower edge) of the contact member 210 extends along the flat portion of the upper portion of the movement preventing member 209. Thus, even if the toner storage unit 121 is to be rotated, the front end of the contact member 210 abut against the flat portion of the upper portion of the movement preventing member 209 so as to effect the operation of preventing the toner storage unit 121 from rotating. That is, the movement preventing member 209 serves to prevent the toner storage unit 121, which has been mounted in the image forming apparatus 100, from rotating.

In addition, the contact member 210 is provided to serve as a guide, by which the movement preventing member 209 is prevented from being bent excessively on the inner side. Thus, the movement preventing member 209 can be prevented from being damaged.

(Others)

Figure 12:
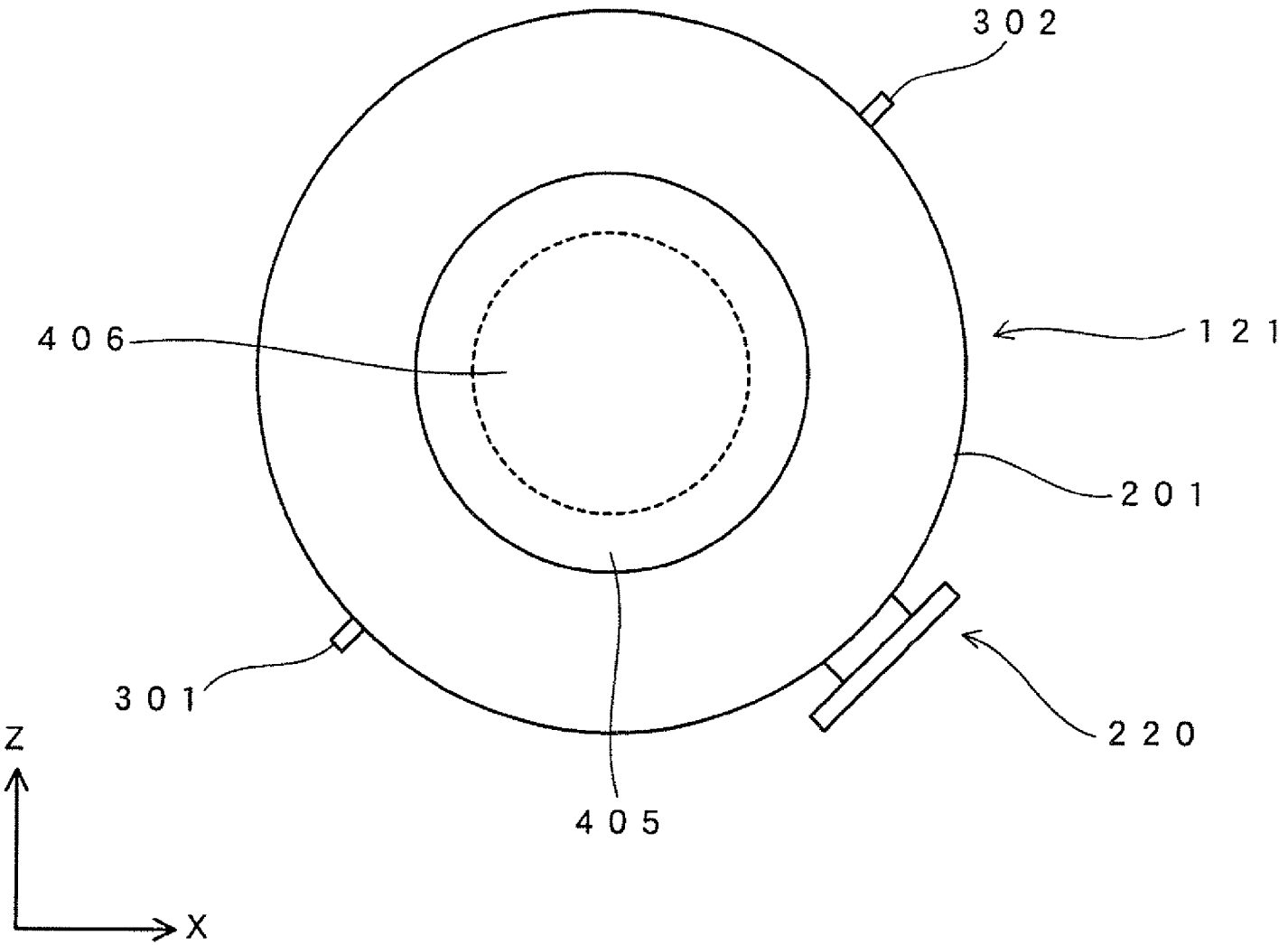
FIG. 12 is a conceptual view showing the back of a toner storage unit body portion.

FIG. 12 shows a state where the grip portion 203 has been removed from the body portion 201. As shown in FIG. 12, a seal portion 405 is provided in an end surface on the grip portion 203 side of the body portion 201. As the seal portion 405, a cover material made from resin is pasted and fixed onto the end surface of the body portion 201 by thermal welding.

A circular opening 406 is provided in the end surface of the body portion 201, and the seal portion 405 closes the opening 406. The opening 406 is required in the manufacturing process of the body portion 201 made from resin. However, the opening 406 is not required in the toner storage state of the toner storage unit 121. Thus, the opening 406 is closed by the seal portion 405.

The seal portion 405 may be fixed to the end surface of the body portion 201 not by thermal welding but by a bonding agent. Alternatively, the seal portion 405 may be composed of an adhesive seal. In this case, the adhesive seal is pasted to seal the opening 406.

The opening 406 may be used for filling the toner storage unit 121 with toner. In this case, the seal portion 405 is first peeled to expose the opening 406. Then, toner is put into the body portion 201 through the opening 406. After filling with toner is completed, a new seal portion 405 is formed to close the opening 406. Thus, the work of filling with toner is carried out using the opening 406.

(Modification)

Each protrusion portion extending longitudinally may be disconnected partially. Alternatively, the protrusion portion may be formed at a plurality of places partially. Also in such a case, a similar function to that of the illustrated embodiment can be obtained. That is, each protrusion portion may extend continuously or discontinuously. The meaning of the expression "extending longitudinally" implies both the case of extending continuously and the case of extending discontinuously.

INDUSTRIAL APPLICABILITY

The invention is applicable to techniques related to an image forming agent storage unit.

The foregoing description of the exemplary embodiment of the present invention has been provided for the purpose of illustration and description. It is not intended to be exhaustive or to limit the invention to the precise forms disclosed. Obviously, many modifications and various will be apparent to practitioners skilled in the art. The embodiments were chosen and described in order to best explain the principles of the invention and its practical application, thereby enabling other skilled in the art to understand the invention for various embodiments and with the various modifications as are suited to the particular use contemplated. It is intended that the scope of the invention be defined by the following claims and their equivalents.

What is claimed is:

1. An image forming agent storage unit for insertion into an image forming apparatus comprising:

a front end portion including a terminal end of the image forming agent storage unit that is configured to be inserted into the image forming apparatus before any other portion of the image forming agent storage unit;

a rear end portion including a terminal end of the image forming agent storage unit that is opposite to the front end portion;

a body portion that extends in an insertion direction in which the image forming agent storage unit is inserted into the image forming apparatus, the body portion connecting the front end portion and the rear end portion; and a pair of a protrusion portions that: i) are disposed on an outer face of the body portion, ii) extend along the insertion direction, and iii) extend longitudinally along an entire length of the body portion, wherein, when the rear end portion is seen along the insertion direction in which the image forming agent storage unit is inserted into the image forming apparatus, an approximate geometrical center of gravity of a cross-sectional shape of the body portion is disposed between the pair of the protrusion portions, and when the rear end portion is seen along the insertion direction in which the image forming agent storage unit is inserted into the image forming apparatus, one of the protrusion portions is disposed on an upper right angle position between an upper portion of the body portion and a right portion of the body portion and the other of the protrusion portions is disposed on a lower left angle position between a lower portion of the body portion and a left portion of the body portion.

2. The image forming agent storage unit according to claim 1, wherein each position of end portions of the protrusion portions in a horizontal direction is set on a position inner to the body portion in a horizontal direction.

3. The image forming agent storage unit according to claim 2, wherein the body portion includes:

a grip portion that is provided in the rear end portion of the body portion; and a contact portion that is provided in the front end portion of the body portion and contacts with the image forming apparatus when the image forming agent storage unit is inserted into the image forming apparatus, wherein at least a part of the pair of the protrusion portions extends to one of the grip portion and the contact portion or both of the grip portion and the contact portion.

4. The image forming agent storage unit according to claim 2, wherein the pair of the protrusion portions guide the image forming agent storage unit so as to be inserted into the image forming apparatus when a user inserts the image forming agent storage unit into the image forming apparatus, and each of the protrusion portions has a side face extending along the insertion direction which is simultaneously visible to the user when the user inserts the image forming agent storage unit into the image forming apparatus.

5. The image forming agent storage unit according to claim 2, wherein the approximate geometrical center of gravity is disposed on a virtual line connecting the pair of the protrusion portions.

6. The image forming agent storage unit according to claim 1, wherein the body portion includes:

a grip portion that is provided in the rear end portion of the body portion; and a contact portion that is provided in the front end portion of the body portion and contacts with the image forming apparatus when the image forming agent storage unit is inserted into the image forming apparatus, wherein at least a part of the pair of the protrusion portions extends to one of the grip portion and the contact portion or both of the grip portion and the contact portion.

7. The image forming agent storage unit according to claim 6 further comprising a pulling-out preventing portion that is disposed on an upper portion of the grip portion and that prevents the body portion from moving in a direction in which the body portion is pulled out from the image forming apparatus by engaging the image forming apparatus.

8. An image forming apparatus comprising:

an image forming agent storage unit that includes:

a front end portion including a terminal end of the image forming agent storage unit that is configured to be inserted into the image forming apparatus before any other portion of the image forming agent storage unit;

a rear end portion including a terminal end of the image forming agent storage unit that is opposite to the front end portion;

a body portion that extends in an insertion direction in which the image forming agent storage unit is inserted into the image forming apparatus, the body portion connecting the front end portion and the rear end portion; and a pair of a protrusion portions that: i) are disposed on an outer face of the body portion, ii) extend along the insertion direction, and iii) extend longitudinally along an entire length of the body portion, wherein, when the rear end portion is seen along the insertion direction in which the image forming agent storage unit is inserted into the image forming apparatus, an approximate geometrical center of gravity of a cross-sectional shape of the body portion is disposed between the pair of the protrusion portions, and when the rear end portion is seen along the insertion direction in which the image forming agent storage unit is inserted into the image forming apparatus, one of the protrusion portions is disposed on an upper right angle position between an upper portion of the body portion and a right portion of the body portion and the other of the protrusion portions is disposed on a lower left angle position between a lower portion of the body portion and a left portion of the body portion; and a developing unit to which an image forming agent is supplied from the image forming agent storage unit.

9. A method of forming an agent storage unit comprising:

forming a front end portion including a terminal end of the image forming agent storage unit that is configured to be inserted into the image forming apparatus before any other portion of the image forming agent storage unit;

forming a rear end portion including a terminal end of the image forming agent storage unit that is opposite to the front end portion;

forming a body portion that extends in an insertion direction in which the image forming agent storage unit is inserted into an image forming apparatus, the body portion connecting the front end portion and the rear end portion; and forming a pair of a protrusion portions that: i) are disposed on an outer face of the body portion, ii) extend along the insertion direction, and iii) extend longitudinally along an entire length of the body portion, wherein, when the rear end portion is seen along the insertion direction in which the image forming agent storage unit is inserted into the image forming apparatus, an approximate geometrical center of gravity of a cross-sectional shape of the body portion is disposed between the pair of the protrusion portions, and when the rear end portion is seen along the insertion direction in which the image forming agent storage unit is inserted into the image forming apparatus, one of the protrusion portions is disposed on an upper right angle position between an upper portion of the body portion and a right portion of the body portion and the other of the protrusion portions is disposed on a lower left angle position between a lower portion of the body portion and a left portion of the body portion.

10. An image forming agent storage unit for insertion into an image forming apparatus comprising:

a body portion that extends in an insertion direction in which the image forming agent storage unit is inserted into the image forming apparatus, the body portion including a front end portion and a rear end portion, the front end portion adapted to be inserted into the image forming apparatus; and a pair of a protrusion portions that are disposed on an outer face of the body portion and extend along the insertion direction, wherein, when the rear end portion is seen along the insertion direction in which the image forming agent storage unit is inserted into the image forming apparatus, an approximate geometrical center of gravity of a cross-sectional shape of the body portion is disposed between the pair of the protrusion portions, and when the rear end portion is seen along the insertion direction in which the image forming agent storage unit is inserted into the image forming apparatus, one of the protrusion portions is disposed on an upper right portion of the body portion and has a rightmost edge, and the other of the protrusion portions is disposed on a lower left portion of the body portion and has a leftmost edge, the rightmost edge of the one of the protrusion portions being located to the left of a rightmost edge of the body portion, and the leftmost edge of the other of the protrusion portions being located to the right of a leftmost edge of the body portion.

11. The image forming agent storage unit according to claim 10, further comprising:

a cover member that is set on the body portion and opens/closes an opening of the body portion, toner stored inside the body portion being discharged from the body portion through the opening, wherein the cover member is configured to be pushed to open the opening of the body portion while the image forming agent storage unit is being inserted into the image forming apparatus in the insertion direction.

* * * * *